US008167177B1

(12) United States Patent
Galgano

(10) Patent No.: US 8,167,177 B1
(45) Date of Patent: May 1, 2012

(54) HANDS FREE HYDRATION SYSTEM

(76) Inventor: Paul V. Galgano, Redondo Beach, CA (US)

( * ) Notice: Subject to any disclaimer, the term of this patent is extended or adjusted under 35 U.S.C. 154(b) by 444 days.

(21) Appl. No.: 12/459,588

(22) Filed: Jul. 3, 2009

Related U.S. Application Data

(60) Provisional application No. 61/133,870, filed on Jul. 3, 2008.

(51) Int. Cl.
*B67D 7/84* (2010.01)
*A45F 3/20* (2006.01)

(52) U.S. Cl. ..... 222/175; 222/192; 222/209; 222/331; 224/148.1; 224/148.2; 239/154; 239/529

(58) Field of Classification Search ..... 222/175, 222/192, 209, 575, 608, 331; 224/148.1, 224/148.2, 219, 221; 239/152–154, 330, 239/529; 446/475
See application file for complete search history.

(56) References Cited

U.S. PATENT DOCUMENTS

| | | | | | |
|---|---|---|---|---|---|
| 836,181 | A * | 11/1906 | Cray | 239/529 |
| 1,533,732 | A * | 4/1925 | Frost | 239/529 |
| 4,037,790 | A * | 7/1977 | Reiser et al. | 239/529 |
| 5,104,016 | A * | 4/1992 | Runkel | 224/148.2 |
| 5,297,541 | A * | 3/1994 | Hensey | 601/40 |
| 5,538,164 | A * | 7/1996 | Rivas | 222/153.04 |
| 6,173,866 | B1 | 1/2001 | Taylor, Jr. et al. | |
| 6,283,344 | B1 | 9/2001 | Bradley | |
| 6,814,260 | B2 * | 11/2004 | Caffrey | 222/175 |
| 2010/0001022 | A1 * | 1/2010 | McInerney | 222/175 |

* cited by examiner

*Primary Examiner* — Kevin P Shaver
*Assistant Examiner* — Nicholas Weiss
(74) *Attorney, Agent, or Firm* — Emery L. Tracy

(57) ABSTRACT

A hydration system for hydrating a user is provided. The user having a hand with fingers and a palm and a wrist connected to the hand. The hydration system comprises a glove portion having a first side and a second side and a wrist portion. A water reservoir is attached to the wrist portion. A water pump is secured to the first side of the glove portion. A first tube connects the water pump to the water reservoir with the first tube spanning the distance between the glove portion and the wrist portion and fluidly connected to both the water pump and the water reservoir. A spritzer is secured to the second side of the glove portion. A second tube connects the water reservoir to the spritzer with the second tube spanning the distance between the wrist portion and the glove portion and fluidly connected to both the water reservoir and the spritzer wherein as the water pump is depressed by the user, air is forced through the first tube into the water dispenser causing the water in the water reservoir to travel from the water reservoir through the second tube and out the spritzer.

20 Claims, 1 Drawing Sheet

HANDS FREE HYDRATION SYSTEM

The present application claims the benefit of priority of pending provisional patent application Ser. No. 61/133,870, filed on Jul. 3, 2008, entitled "Hands Free Hydration System".

BACKGROUND OF THE INVENTION

1. Field of the Invention

This invention relates generally to a hands free hydration system and, more particularly, the invention relates to a hands free hydration system worn directly on the wrist that is specially designed to store and dispense water.

2. Description of the Prior Art

In few areas do Americans' taste vary as widely as in beverages. Once they have reached the point where milk is not the only game in town, choices provide an almost unending assortment of drinks, with each category containing a plethora of selections. From frothy cappuccinos and herbal teas to citrus-tinged colas and fruity combination juices featuring apple and papaya, there is sure to be a tasty beverage for anyone.

In addition to providing a refreshing liquid to accentuate a meal or a needed boost of energy in the mornings, beverages also serve a practical and healthy purpose. In particular, human survival depends on drinking water. Water is necessary for the digestion and absorption of food, helps maintain proper muscle tone, supplies oxygen and nutrients to the cells, rids the body of wastes, and serves as a natural air conditioning system. Health officials emphasize the importance of drinking at least eight glasses of clean water each and every day to maintain good health. Perhaps it is most important for those who regularly participate in some form of exercise or sporting activity to drink plenty of water while exerting themselves in such a manner. While working out, the body expunges its moisture through perspiration, so it is especially important to avoid dehydration by having water or other liquid within reach at all times.

While keeping the body hydrated when exercising is vital, finding a way to conveniently hold on to a container of water when active can be daunting and frustrating. As many consumers can attest, carrying around a heavy, bulky water bottle or other beverage container while running or working out at the gym is, quite often, simply not practical. Having to utilize the entire hand in order to maintain a firm grip on the beverage, active consumers are unable to appropriate that hand to carry other items that may be needed when the other hand is full, such as keys, a cell phone, or a purse. Wishing to be unencumbered, these consumers may opt to simply discard the beverage container, wasting expensive, unused beverage portions and denying their bodies much needed hydration.

SUMMARY

The present invention is a hydration system for hydrating a user. The user having a hand with fingers and a palm and a wrist connected to the hand. The hydration system comprises a glove portion having a first side and a second side and a wrist portion. A water reservoir is attached to the wrist portion. A water pump is secured to the first side of the glove portion. A first tube connects the water pump to the water reservoir with the first tube spanning the distance between the glove portion and the wrist portion and fluidly connected to both the water pump and the water reservoir. A spritzer is secured to the second side of the glove portion. A second tube connects the water reservoir to the spritzer with the second tube spanning the distance between the wrist portion and the glove portion and fluidly connected to both the water reservoir and the spritzer wherein as the water pump is depressed by the user, air is forced through the first tube into the water dispenser causing the water in the water reservoir to travel from the water reservoir through the second tube and out the spritzer.

The present invention further includes a method for hydrating a user. The user has a hand with fingers and a palm and a wrist connected to the hand. The method comprises providing a glove portion having a first side and a second side, providing a wrist portion, attaching a water reservoir to the wrist portion, securing a water pump to the first side of the glove portion, connecting a first tube between the water pump to the water reservoir with the first tube spanning the distance between the glove portion and the wrist portion and fluidly connected to both the water pump and the water reservoir, securing a spritzer to the second side of the glove portion, connecting a second tube between the water reservoir to the spritzer with the second tube spanning the distance between the wrist portion and the glove portion and fluidly connected to both the water reservoir and the spritzer, depressing the water pump, and forcing air through the first tube into the water dispenser causing the water in the water reservoir to travel from the water reservoir through the second tube and out the spritzer.

DETAILED DESCRIPTION OF THE PREFERRED EMBODIMENTS

Figure 2:
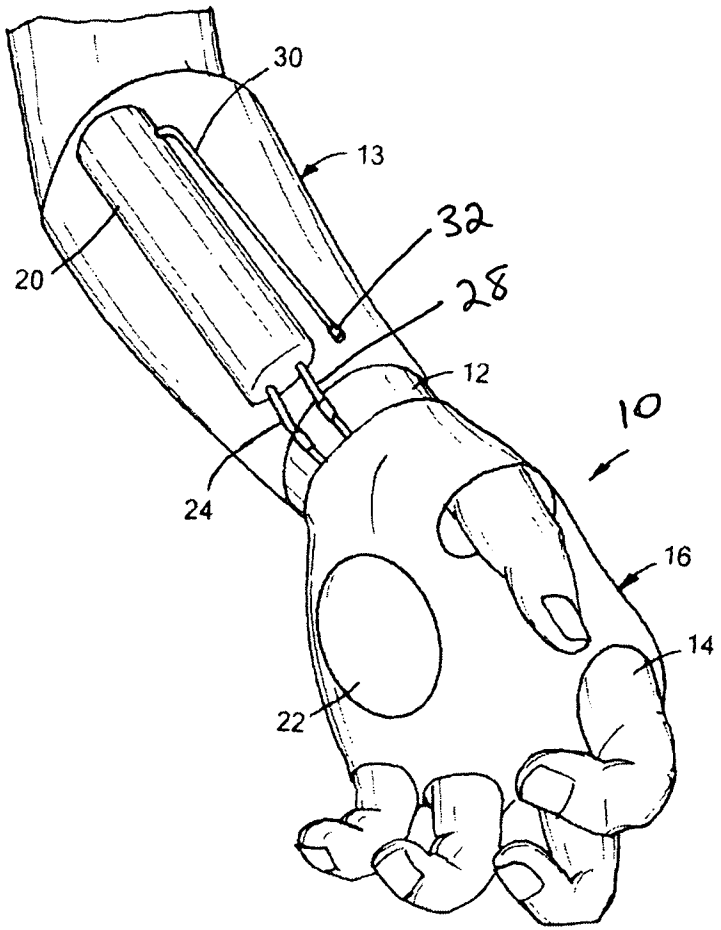
FIG. 2 is a bottom perspective view illustrating the hand free hydration system, constructed in accordance with the present invention.
Figure 1:
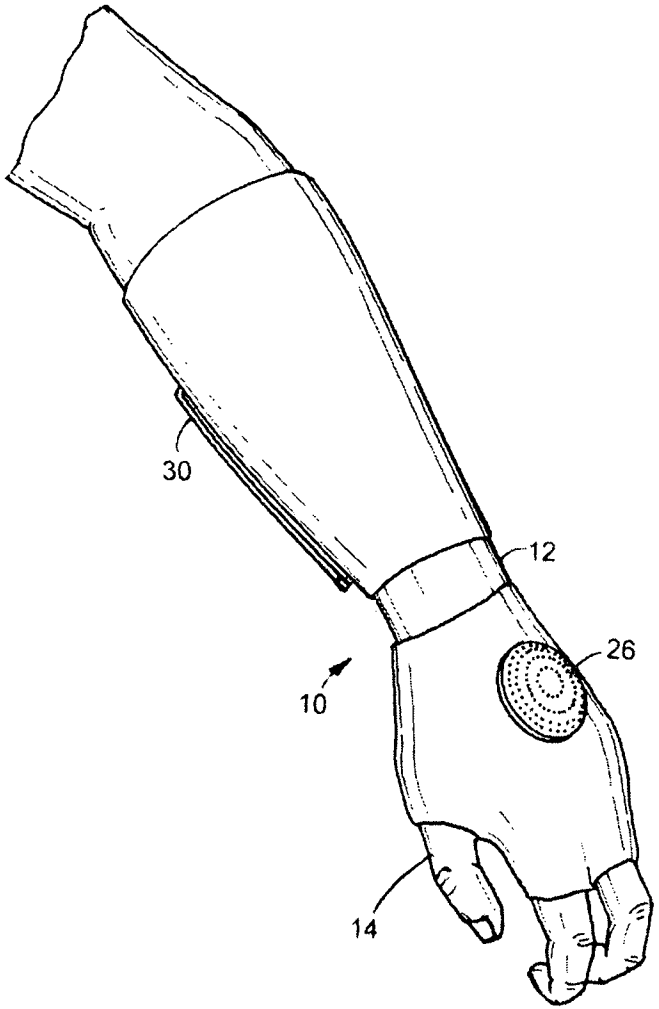
FIG. 1 is a top perspective view illustrating a hand free hydration system, constructed in accordance with the present invention.

As illustrated in FIGS. 1 and 2, the present invention is a hands free hydration system, indicated at 10, offering a convenient solution to the problem of beverage container portability. The hands free hydration system 10 of the present invention is an apparatus worn directly on the wrist 12 and hand 14 of a user that is specially designed to store and dispense water.

The hydration system 10 of the present invention has a lightweight and flexible combination glove 16 and wristband 18 and the actual lubricant dispenser. The glove 16 and wristband 18 can be manufactured from a variety of materials including cotton, nylon, leather, or spandex, to name a few considerations. In a preferred embodiment, the glove 16 and wristband 18 and constructed from an airflow hybrid mesh which wicks away moisture and circulates air through the glove 16 and wristband 18. It should be noted that the glove 16 and wristband 18 can be constructed from the same material or different material.

The glove 16 of the hydration system 10 of the present invention can be a complete glove with the fingers covered or a fingerless glove, as illustrated. Furthermore, it is within the scope of the present invention for the glove 16 and the wristband 18 to be distinct separate components, constructed from a single piece of material, or connected together by material, stitching, or other means.

The wristband 18 of the hydration system of the present invention can be constructed as a one-piece unit designed to be slid over the wrist 12 and manufactured in a one-size-fits-all standard. As such, the hydration system wristband 18 features stretchy elastic threading ensuring a custom like fit. Alternately, the hydration system wristband 18 can be an adjustable unit held closed over the wrist 12 by way of simple buckle closures or self-affixing hook and loop fasteners.

The most notable aspect of the hydration system 10 of the present invention is found in the actual water dispenser or reservoir 20, integrally attached to the wristband 18. Preferably constructed of lightweight plastic or similar synthetic material, the water reservoir 20 is perpendicularly attached to the wristband 18 and positionable over the underside of the wrist 12, directly below the palm. The water reservoir 20 is preferably sized to hold approximately six (6 oz.) ounces to approximately twelve (12 oz.) ounces of water although a water reservoir 20 holding different amounts of water is within the scope of the present invention. The water reservoir 20 preferably includes a closable fill aperture for allowing easy filling of the water reservoir 20 when necessary.

The hydration system 10 of the present invention further includes a water pump 22 secured to the palm side of the glove 14. The water pump 22 is connected to the water reservoir 20 via a first tube 24. The first tube 24 spans the distance between the glove 16 and the wristband 18 and is fluidly connected to both the water pump 22 and the water reservoir 20. In operation, as the water pump 22 is depressed by the user, air is forced through the first tube 24 into the water reservoir 20 causing the water in the water reservoir 20 to travel from the water reservoir. The first tube 24 has a one-way valve allowing air to travel into the water reservoir and not the other direction.

Secured to the top of the glove 16 of the hydration system 10 of the present invention is a spritzer 26 through which water is conveniently sprayed directly onto the face to cool off. In operation, as the user pumps the water pump 26, the water travels through a second tube 28 spanning the distance between the glove 16 and the wristband 18 and out the spritzer 26. Fluid tight connections of the second tube 26 with the water reservoir 20 and the spritzer 26 provide a fluid tight seal inhibiting leaks.

A rotatable tube 30 is fluidly connected to the water reservoir 20 of the hydration system 10 of the present invention. A bite valve 32 is secured to the end of the rotatable tube 30. In operation, the user can bite or otherwise depress the bite valve 32 and drink water from the water reservoir 20 by suction. Furthermore, the hydration system 10 can be produced in an array of fun and funky colors, as well as in neutral beige, black, or white.

The hydration system 10 of the present invention offers consumers many significant benefits and advantages. Foremost, the hydration system 10 provides more convenient, hands free means of rehydrating while exercising. Eliminating the need to use the hands to hold bulky, round water bottles and similar beverage containers while exercising or on the go, the hydration system 10 allows users to enjoy their activities much less encumbered. In this manner, consumers are able to use their hands to carry other necessary items, such as keys, a wallet, a gym bag, or nothing at all. As the hydration system 10 effectively eases the transporting burden, the user is not so quick to dispose of unfinished beverages simply in order to free the hands. As a result, money is saved by not wasting these costly liquids and rehydrating liquids would be readily accessible when needed.

Aspects of the hydration system's product design offer other significant advantages. With its clever incorporation of an attached water receptacle, the hydration system 10 facilitates easy accessibility to as well as security of the liquid inside, making this product ideal for children as well as adults. In addition, the durable plastic material that comprises the hydration system 10 allows the product to be reused as many times as desired, allowing consumers to save money in water costs while also benefiting the environment. While particularly ideal for those who regularly exercise or participate in sporting activities, the hydration system 10 proves invaluable to campers, hikers, students, and virtually anyone who enjoys beverages.

The hydration system 10 of the present invention provides active consumers with a convenient, portable beverage container. Lightweight and easy to use, the hydration system 10 allows runners, walkers, and others who enjoy exercise a simplified means of rehydration. In addition, the hydration system 10 is perfect for everyday use as well.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A hydration system for hydrating a user, the user having a hand with fingers and a palm and a wrist connected to the hand, the hydration system comprising:

a glove portion having a first side and a second side;

a wrist portion;

a water reservoir attached to the wrist portion;

a water pump secured to the first side of the glove portion;

a first tube connecting the water pump to the water reservoir, the first tube spanning the distance between the glove portion and the wrist portion and fluidly connected to both the water pump and the water reservoir;

a spritzer secured to the second side of the glove portion; and a second tube connecting the water reservoir to the spritzer, the second tube spanning the distance between the wrist portion and the glove portion and fluidly connected to both the water reservoir and the spritzer;

wherein as the user depresses the water pump, air is forced through the first tube into the water dispenser causing the water in the water reservoir to travel from the water reservoir through the second tube and out the spritzer.

2. The hydration system of claim 1 and further comprising:

a rotatable tube having a first end and a second end, the first end of the rotatable tube fluidly connected to the water reservoir; and a bite valve secured to the second end of the rotatable tube;

wherein upon a user depressing the bite valve, water from the water reservoir travels into the tube and out of the bite valve by suction.

3. The hydration system of claim 1 wherein the glove portion and the wrist portion are constructed from an airflow hybrid mesh which wicks away moisture and circulates air through the glove portion and the wrist portion.

4. The hydration system of claim 1 wherein the glove portion is selected from a glove consisting of a complete glove with fingers covered or a fingerless glove.

5. The hydration system of claim 1 wherein the glove portion and the wrist portion are selected from a group consisting of a separate glove and wristband, a combined glove and wristband, and a glove and wristband connected together by material, stitching, or other means.

6. The hydration system of claim 1 wherein the wrist portion has stretchy elastic threading.

7. The hydration system of claim 1 wherein the wrist portion is an adjustable unit held closed over the wrist by way of buckle closures or self-affixing hook and loop fasteners.

8. The hydration system of claim 1 wherein the water reservoir is perpendicularly attached to the wrist portion and positionable over an underside of the wrist, directly below a palm.

9. The hydration system of claim 1 and further comprising:

a closable fill aperture formed in the water reservoir.

10. The hydration system of claim 1 wherein the first tube and the second tube each has a one-way valve.

11. A method for hydrating a user, the user having a hand with fingers and a palm and a wrist connected to the hand, the method comprising:

providing a glove portion having a first side and a second side;

providing a wrist portion;

attaching a water reservoir to the wrist portion;

securing a water pump to the first side of the glove portion;

connecting a first tube between the water pump to the water reservoir, the first tube spanning the distance between the glove portion and the wrist portion and fluidly connected to both the water pump and the water reservoir;

securing a spritzer to the second side of the glove portion;

connecting a second tube between the water reservoir to the spritzer, the second tube spanning the distance between the wrist portion and the glove portion and fluidly connected to both the water reservoir and the spritzer;

depressing the water pump; and forcing air through the first tube into the water dispenser causing the water in the water reservoir to travel from the water reservoir through the second tube and out the spritzer.

12. The method of claim 11 and further comprising:

providing a rotatable tube having a first end and a second end;

fluidly connecting the first end of the rotatable tube to the water reservoir;

securing a bite valve to the second end of the rotatable tube;

rotating the tube relative to the water reservoir;

depressing the bite valve; and receiving water from the water reservoir out of the bite valve.

13. The method of claim 11 wherein the wrist portion has stretchy elastic threading.

14. The method of claim 11 wherein the wrist portion is an adjustable unit held closed over the wrist by way of buckle closures or self-affixing hook and loop fasteners.

15. The method of claim 11 and further comprising:

attaching the water reservoir perpendicularly to the wrist portion and positioning the water reservoir over an underside of the wrist, directly below a palm.

16. The method of claim 11 and further comprising:

forming a closable fill aperture in the water reservoir.

17. The method of claim 11 wherein the first tube and the second tube each has a one-way valve.

18. A hydration system for hydrating a user, the user having a hand with fingers and a palm and a wrist connected to the hand, the hydration system comprising:

a glove portion having a first side and a second side;

a wrist portion;

a water reservoir attached to the wrist portion;

a water pump secured to the first side of the glove portion;

a first tube having a one-way valve connecting the water pump to the water reservoir, the first tube spanning the distance between the glove portion and the wrist portion and fluidly connected to both the water pump and the water reservoir;

a spritzer secured to the second side of the glove portion; and a second tube having a one-way valve connecting the water reservoir to the spritzer, the second tube spanning the distance between the wrist portion and the glove portion and fluidly connected to both the water reservoir and the spritzer;

a rotatable tube having a first end and a second end, the first end of the rotatable tube fluidly connected to the water reservoir;

a bite valve secured to the second end of the rotatable tube;

wherein as the water pump is depressed by the user, air is forced through the first tube into the water dispenser causing the water in the water reservoir to travel from the water reservoir through the second tube and out the spritzer; and wherein upon a user depressing the bite valve, water from the water reservoir travels into the tube and out of the bite valve by suction.

19. The hydration system of claim 18 wherein the water reservoir is perpendicularly attached to the wrist portion and positionable over an underside of the wrist, directly below a palm.

20. The hydration system of claim 18 and further comprising:

a closable fill aperture formed in the water reservoir.

* * * * *